US006640817B2

(12) United States Patent
Harmon

(10) Patent No.: US 6,640,817 B2
(45) Date of Patent: Nov. 4, 2003

(54) METHOD FOR REMOVING CONCRETE FROM INTERIOR SURFACES OF A CONCRETE MIXING DRUM

(76) Inventor: Thomas G. Harmon, 55 Clermont La., St. Louis, MO (US) 63124

( * ) Notice: Subject to any disclaimer, the term of this patent is extended or adjusted under 35 U.S.C. 154(b) by 0 days.

(21) Appl. No.: 10/191,834

(22) Filed: Jul. 9, 2002

(65) Prior Publication Data

US 2002/0179119 A1 Dec. 5, 2002

Related U.S. Application Data

(62) Division of application No. 09/183,633, filed on Oct. 30, 1998, now Pat. No. 6,418,948.

(51) Int. Cl.[7] ..... B08B 3/02

(52) U.S. Cl. ..... 134/22.18; 134/22.1; 134/24; 366/348

(58) Field of Search ..... 134/22.1, 22.18, 134/24, 168 R, 167 R, 174, 198; 366/138, 348

(56) References Cited

U.S. PATENT DOCUMENTS

| | | | | |
|---|---|---|---|---|
| 2,282,694 A | * | 5/1942 | Ball | |
| 2,338,820 A | * | 1/1944 | Peters | |
| 2,537,585 A | * | 1/1951 | Hilkemier | |
| 3,444,869 A | | 5/1969 | Guignon et al. | 134/167 |
| 3,606,162 A | | 9/1971 | Lehmann | 239/227 |
| 4,013,518 A | | 3/1977 | Miko | 202/241 |
| 4,163,455 A | | 8/1979 | Hebert et al. | 134/167 R |
| 4,201,341 A | | 5/1980 | Hühne et al. | 239/79 |
| 4,201,597 A | | 5/1980 | Armstrong et al. | 134/167 R |
| 4,544,275 A | * | 10/1985 | Hudelmaier | |
| 4,585,355 A | * | 4/1986 | Waitzinger | |
| 4,805,653 A | | 2/1989 | Krajicek et al. | 134/166 C |
| 5,071,377 A | | 12/1991 | Saunders et al. | 440/88 |
| 5,228,919 A | | 7/1993 | Baker | 118/323 |
| 5,240,503 A | | 8/1993 | Levy et al. | 118/323 |
| 5,244,498 A | * | 9/1993 | Steinke | |
| 5,377,913 A | | 1/1995 | Van Der Woude | 238/227 |
| 5,378,282 A | | 1/1995 | Pollard | 118/697 |
| 5,419,496 A | * | 5/1995 | Novak, Jr. | |
| 5,503,115 A | | 4/1996 | Franzke et al. | 122/390 |
| 5,513,911 A | * | 5/1996 | Schwing | |
| 5,579,787 A | | 12/1996 | Wood | 134/22.1 |
| 5,594,973 A | | 1/1997 | Brusseleers et al. | 15/304 |
| 5,601,051 A | | 2/1997 | Bajek | 118/306 |
| 5,656,085 A | | 8/1997 | Hezel | 118/323 |
| 5,656,089 A | | 8/1997 | Rouvelin | 118/663 |
| 5,733,374 A | | 3/1998 | Ekenberg | 118/323 |

FOREIGN PATENT DOCUMENTS

| | | | |
|---|---|---|---|
| GB | 718292 | | 12/1952 |
| GB | 2268048 | * | 1/1994 |
| JP | 57-7730 | * | 1/1982 |
| JP | 1198964 | | 8/1989 |
| JP | 6285436 | | 10/1994 |
| RU | 1638024 | * | 3/1991 |
| SE | 8802328 | * | 12/1989 |

* cited by examiner

*Primary Examiner*—Frankie L. Stinson
(74) *Attorney, Agent, or Firm*—Haverstock, Garrett & Roberts LLP

(57) ABSTRACT

A method for removing concrete from the interior surfaces of a concrete mixing drum, the drum including an open end and at least one interior surface facing away from or opposite the open end, an elongate probe having a longitudinal axis and an axially extending forward end being inserted into the drum through the open end thereof; and at least one fluid nozzle being mounted to the probe in position for discharging a stream of fluid against the at least one interior surface facing opposite the open end under sufficient pressure to dislodge accumulated concrete therefrom as the probe is moved in the drum.

7 Claims, 5 Drawing Sheets

METHOD FOR REMOVING CONCRETE FROM INTERIOR SURFACES OF A CONCRETE MIXING DRUM

This application is a divisional application of parent U.S. patent application Ser. No. 09/183,633, filed Oct. 30, 1998 now U.S. Pat. No. 6,418,948.

TECHNICAL FIELD

The present invention relates generally to apparatus for removing residual concrete from the interior of a concrete mixing drum, and more particularly to apparatus including an elongate probe supported for axial movement into and out of an open end of the drum, preferably automatically, and including at least one nozzle positioned for discharging fluid under pressure against difficult to access interior surfaces of the drum, particularly surfaces on helical ribs or flights facing away from the open end of the drum, on which surfaces concrete tends to cure and accumulate, for dislodging and removing the concrete.

BACKGROUND ART

Ready-mix concrete trucks have a rotatable drum for holding a quantity of ready-mix concrete. The drum typically includes several raised helical ribs or flights extending around its interior surfaces. These ribs act to mix the concrete when the drum is rotated in one direction, and when the drum is rotated in the opposite direction, the ribs lift the concrete to an elevated opening, either at the front or rear of the drum, through which the concrete is discharged from the drum. Over the course of operation, concrete has been found to accumulate on the surfaces in the drum, particularly on the rib surfaces facing away from the open end of the drum. This concrete, if left in place to cure and harden, has been found to decrease the effectiveness of the ribs for both mixing and lifting the concrete, and adds weight to the truck. The concrete, if allowed to accumulate, will also lessen the capacity of the drum. Therefore, it is common practice, at the end of each day, or more often, to wash the interior of the drum. However, the washing typically requires as much as 300 gallons of water, and still has been found to be ineffective at removing the accumulated concrete from the surfaces of the ribs facing opposite the open end of the drum, especially if the concrete is allowed to cure and harden.

Reference Steinke U.S. Pat. No. 5,244,498 issued Sep. 14, 1993 to W.R. Grace and Co. of Canada Limited; and Hailey U.S. Pat. No. 5,507,875 issued Apr. 16, 1996, which disclose various known apparatus and methods for cleaning concrete mixing drums. More particularly, Steinke teaches manual insertion of a hand held elongate probe into a concrete mixing drum for spraying a set retarding agent against the residual concrete on the inner surface of the drum for removing the concrete. Hailey discloses utilizing a vibration impact device applied against the exterior of the concrete mixing drum for loosening and dislodging the accumulated concrete.

Shortcomings of relying on a retarding agent such as disclosed in Steinke for ridding a concrete mixing drum of residual concrete include observed ineffectiveness of the retarding agents under a variety of environmental conditions such as elevated temperatures. Additionally, the retarding agents have been found to be generally ineffective for removing concrete that has largely or mostly cured. Limitations of using hand held devices like the Steinke probe include unwieldiness when fully extended into a drum, particularly when using pressurized fluids. Also, it is unsafe to rotate the drum when any hand held device is used therein.

Shortcomings of vibrational methods of cleaning concrete mixing drums such as disclosed in Hailey include the noise generated by the vibrating devices and the time required. Further, it has been found that the known cleaning apparatus and methods often still leave sufficient residual concrete on the interior surfaces of the drum so as to require periodic manual cleaning.

Manual cleaning typically involves a worker entering the drum, and, using a water hose and hand tools as required, loosening the concrete from the drum surfaces and washing the concrete pieces to the bottom of the drum. Then, the worker exits the drum, and the drum is rotated so as to discharge the cleaning water and concrete pieces from the drum. Shortcomings here include the possibility of the worker being injured while entering or exiting the drum, which requires a ladder or similar means, or from slipping or falling on the wet surfaces in the drum. The worker can also be injured by loosened pieces of concrete which can fall from the upper surfaces in the drum. Also, it is noisy in the drum during the cleaning operation as a jackhammer, sledge hammer or similar device is typically used to beat the concrete off of the interior surfaces.

Accordingly, the present invention is directed to overcoming one or more of the shortcomings as discussed above.

DISCLOSURE OF THE INVENTION

In one embodiment of the present invention, an apparatus for removing concrete from the interior surfaces of a concrete mixing drum is disclosed, the drum including an open end and at least one interior surface facing away from or opposite the open end, the apparatus comprising an elongate probe having a longitudinal axis and an axially extending forward end adapted for insertion into the drum through the open end thereof; a vertically adjustable support structure supporting a guideway support, the guideway support including at least one bearing adapted for supporting the probe for movement of the forward end thereof into and out of the drum through the open end thereof; and at least one fluid nozzle mounted to the probe in position for discharging a stream of fluid against the at least one interior surface facing opposite the open end under sufficient pressure to dislodge accumulated concrete therefrom as the probe is moved in the drum.

In a preferred method of operation, the elongate probe of the apparatus is positioned for insertion of the forward end thereof into the open end of the drum. The probe can then be axially moved into the drum and the fluid under pressure delivered through the fluid conduit to the nozzle for discharging the stream of fluid under pressure against the interior drum surface for dislodging the concrete. During this time, the drum is rotated in the discharge direction and the probe is moved axially into or out of the drum such that the interior surfaces thereof, most importantly the surfaces of the helical ribs or flights facing away from the open end of the drum, are reached by the stream of fluid. Then, once the probe has traversed essentially the length of the drum, the probe is withdrawn from the drum, and the concrete removal operation is complete when the dislodged material is discharged from the drum.

In a preferred aspect of the invention, at least four fluid nozzles are provided at different positions adjacent the end of the probe for discharging the streams of fluid under pressure in different directions, the preferred fluid stream being a pencil shaped stream, although solid cone shaped streams, hollow cone shaped streams, and fan shaped streams, can likewise be used.

Here, is should be recognized that the fluid stream can comprise any material effective for dislodging accumulated concrete from the drum surfaces, including, but not limited to, liquids such as water either alone or including a detergent, gritty matter or the like which can be introduced into the fluid stream after discharge from the nozzle; and cryogenic materials such as pelletized dry ice, and the like.

BEST MODE FOR CARRYING OUT THE INVENTION

Figure 1:
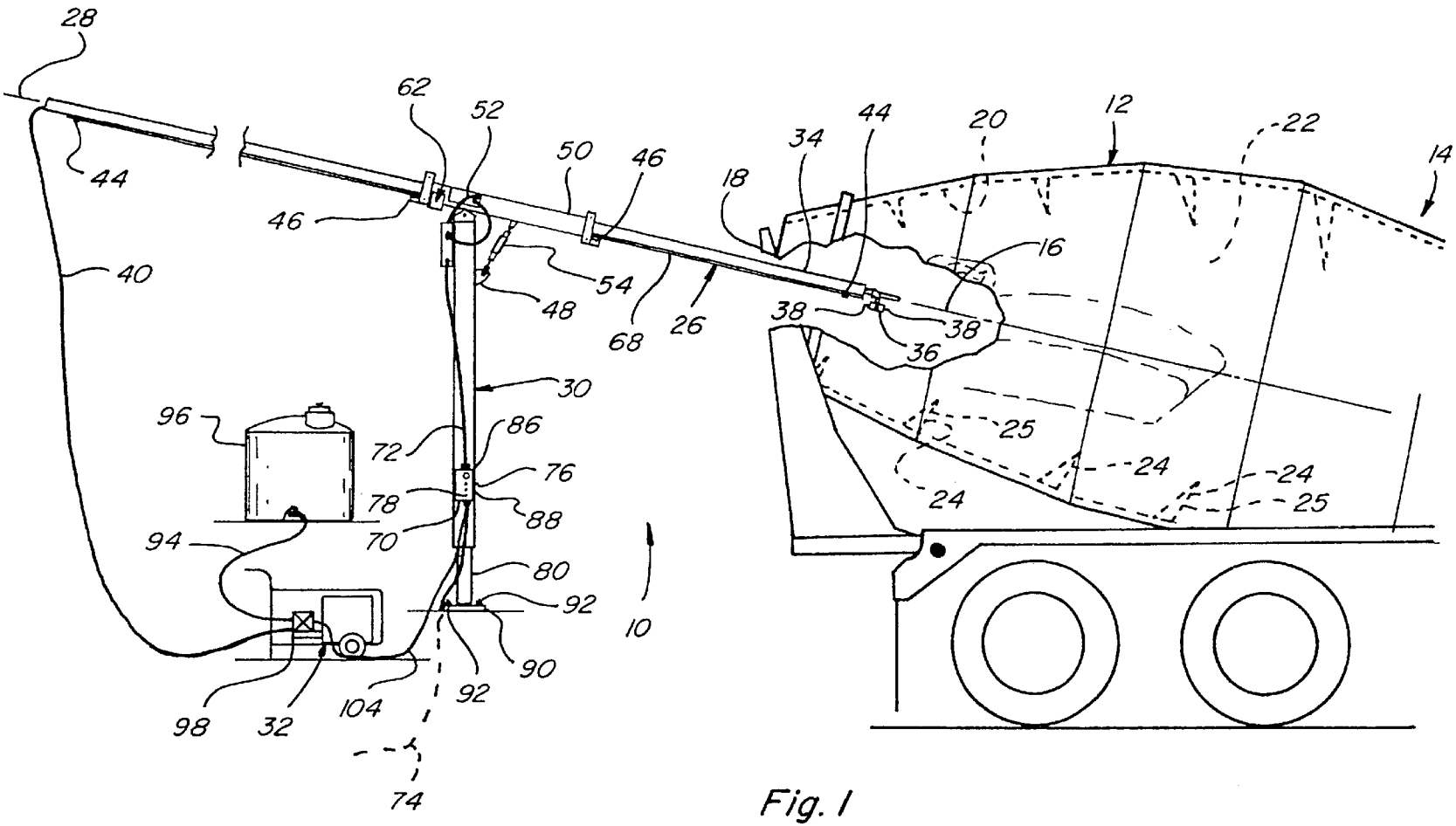
FIG. 1 is a schematic representation of apparatus for removing concrete from the interior surfaces of a concrete mixing drum according to the present invention shown in operative position for use in a concrete mixing drum of a ready-mix delivery truck.

Referring to the drawings, FIG. 1 shows apparatus 10 constructed and operable according to the teachings of the present invention for removing concrete from the interior of a concrete mixing drum. Apparatus 10 is shown in operative position for cleaning the interior of a conventional rotatable concrete mixing drum 12 of a ready mix delivery truck 14. Truck 14 is representative of a wide variety of trucks for mixing and delivering concrete to job sites, and generally includes means operable for rotating drum 12 in a clockwise direction, and also a counter clockwise direction, about a drum axis 16, as desired. Drum 12 includes an open end 18, and an interior surface 20 defining an interior cavity 22. A plurality of helical ribs 24 extend around interior surface 20 and are operable when the drum is rotated in one direction to mix concrete located in interior cavity 22, and lift the concrete for discharge through open end 18 when the drum is rotated in the opposite direction. Helical ribs 24 each have a surface 25 extending around cavity 22, which surfaces 25 face away from open end 18 and are often orientated at an acute angle to surface 20. Here, it should be noted and understood that drum 12 is contemplated to be representative of a wide variety of commercially available drums of different sizes, shapes, and number and arrangement of helical ribs 24 or flights, apparatus 10 having utility for removing concrete from the interior surfaces of all such drums.

Apparatus 10 includes an elongate probe 26. Probe 26 is supported for longitudinal movement along a longitudinal axis 28 thereof by a vertically adjustable support structure 30. Apparatus 10 further includes a powered pump for delivering fluid under pressure to probe 26. Elongate probe 26 is preferably from about 20 to about 30 feet long, the length thereof depending on the length of the drum being cleaned, a length of 28 feet having been found to be adequate for most applications tested. Probe 26 includes an axially extending forward end portion 34 adapted for insertion into a drum, such as drum 12, through the open end thereof. Forward end portion 34 includes a nozzle manifold 36 mounted adjacent the forward end thereof, nozzle manifold 36 having a plurality of nozzles 38 mounted thereto.

Figure 2:
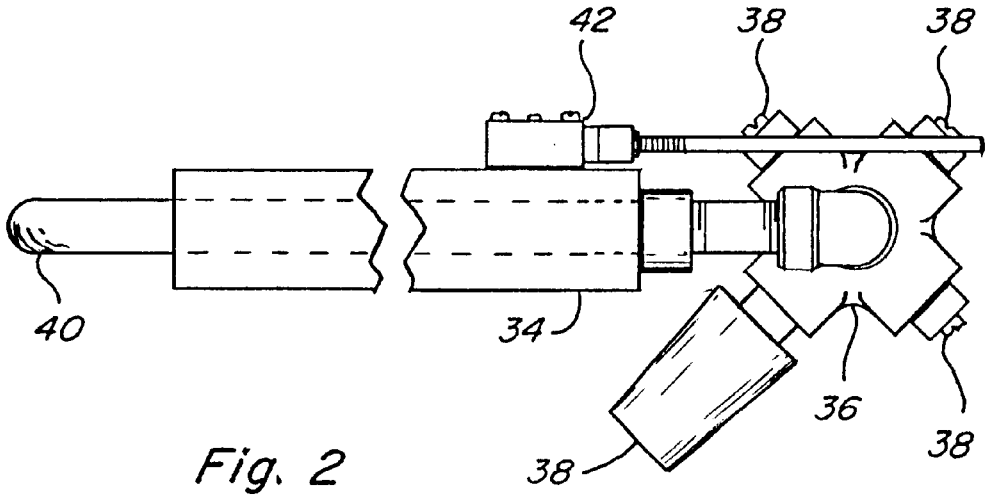
FIG. 2 is a top view of an elongate probe of the apparatus of FIG. 1.

Referring also to FIG. 2, nozzles 38 are arranged in an angularly spaced, horizontal array such that each nozzle is pointed in a different direction. Each nozzle is adapted for discharging a stream of fluid under pressure against the interior surface 20 of drum 12. The preferred stream is a narrow or pencil shaped stream, other streams such as solid cones, hollow cones and fan shaped streams also being usable. Each nozzle preferably has an oppositely facing counterpart such that the forces generated by the oppositely directed streams discharging therefrom largely cancel each other or balance out. A high pressure hose 40 is connected between nozzle manifold 36 and pump 32, providing a fluid conduit for the flow of fluid under pressure from pump 32 to manifold 36, the pressurized fluid being distributed through manifold 36 to respective nozzles 38 for discharge therethrough. Hose 40 preferably extends through probe 26 (FIG. 4) but could alternatively be mounted externally thereto, as desired. Other preferred features of probe 26 include an optional conventionally constructed and operable stop switch 42 for stopping the powered longitudinal advance of probe 26 when the end of drum 12 opposite open end 18 or other obstacles are contacted.

Figure 3:
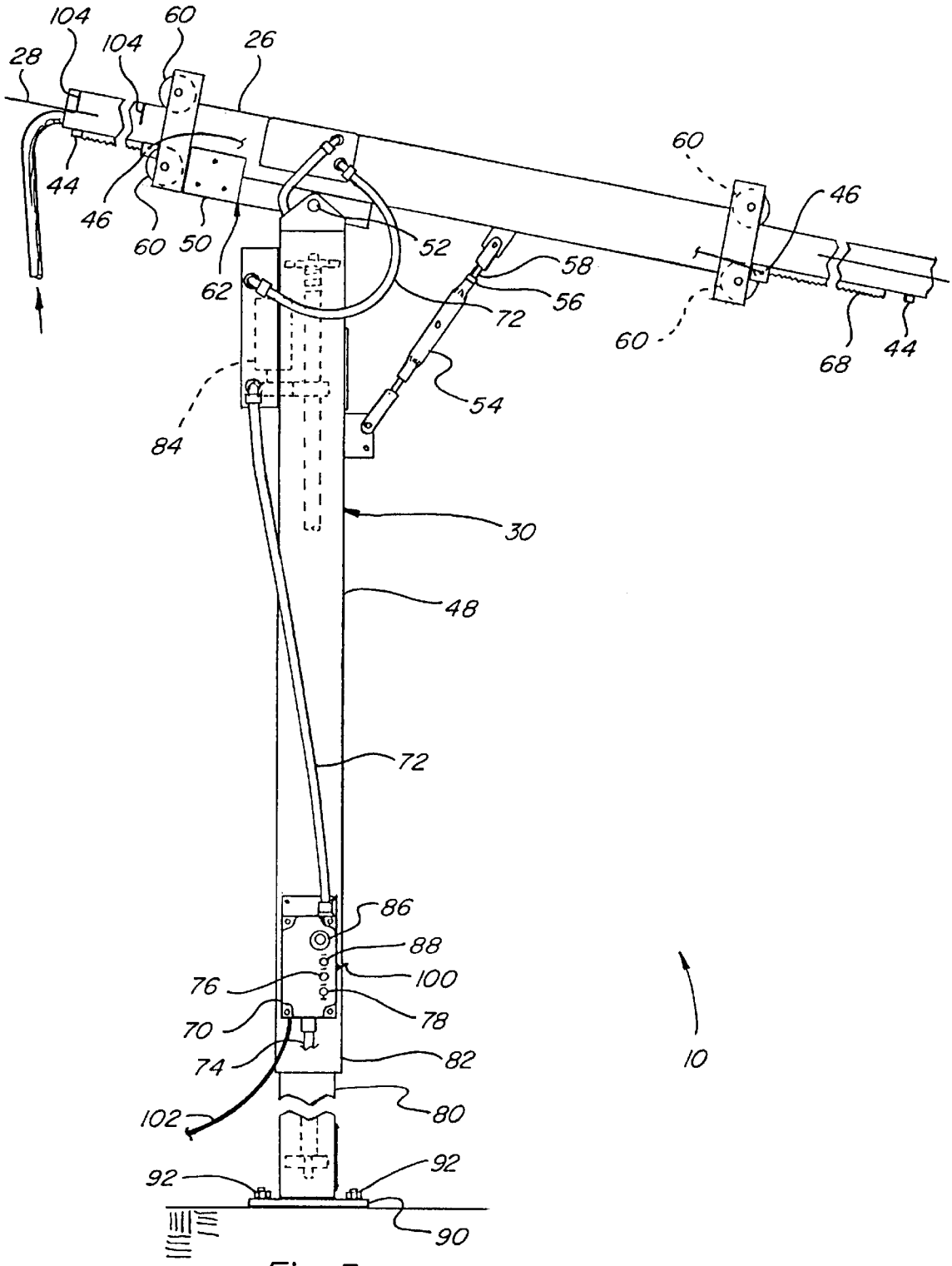
FIG. 3 is a fragmentary side view of support structure of the apparatus of FIG. 1.

Referring to FIG. 3, magnets 44 are located at predetermined locations on probe 26 for activating proximity switches 46 located adjacent the respective opposite ends of support structure 30 and operable in the conventional manner for limiting the longitudinal travel of probe 26, as will be explained. Support structure 30 includes an upstanding column 48 of tubular or similar construction and a guideway support 50 pivotally mounted cross-wise at pivot 52 to column 48 for pivotal movement in a generally vertical plane relative to the column. An adjustable turnbuckle 54 extends between column 48 and guideway support 50. Turnbuckle 54 is a manually adjustable device of conventional construction and adjustment thereof by relative rotation of a threaded nut 56 and a threaded rod 58 enables positioning probe 26 at a suitable angular orientation for insertion into a drum such as drum 12 through the open end thereof. Here, it should be noted that it has been found that an angle of between about 11° and about 13° to horizontal is suitable to allow insertion of probe 26 into the drums of a wide variety of ready mix trucks. It should also be noted that it is not critical that the probe angle match the angle of the drum axis, with the additional cautionary note that probe 26 should be capable of being extended into and withdrawn from a drum without contacting the drum.

Figure 4:
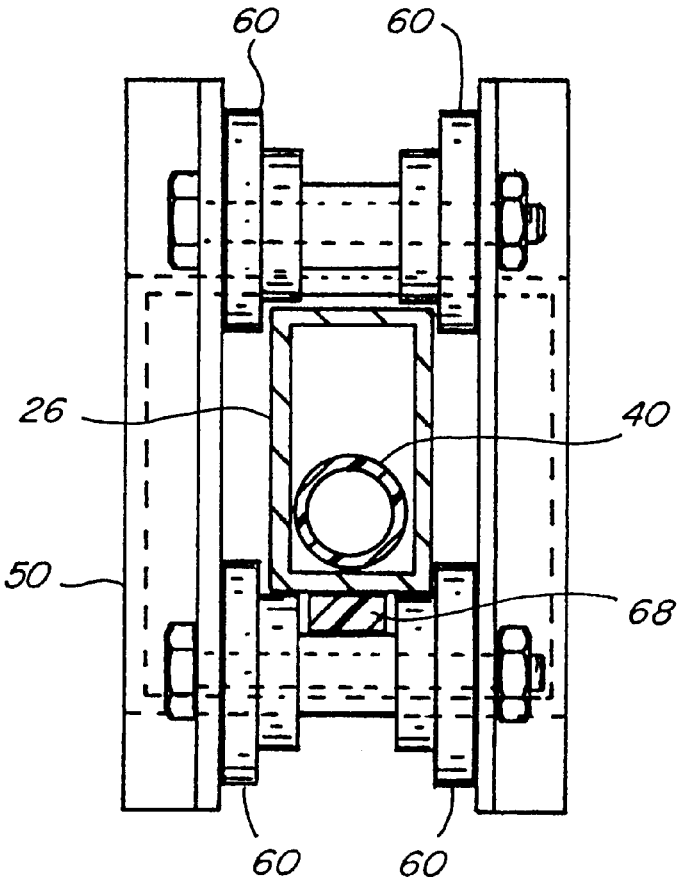
FIG. 4 is a end view of the apparatus of FIG. 1.

Referring also to FIG. 4, guideway support 50 is preferably a tubular member or truss of at least 4 feet in length and having an interior cavity adapted for receiving probe 26. Probe 26 is supported within and by guideway support 50 for longitudinal movement along axis 28 by a plurality of bearings 60 located at upper and lower positions adjacent the ends of guideway support 50.

Figure 5:
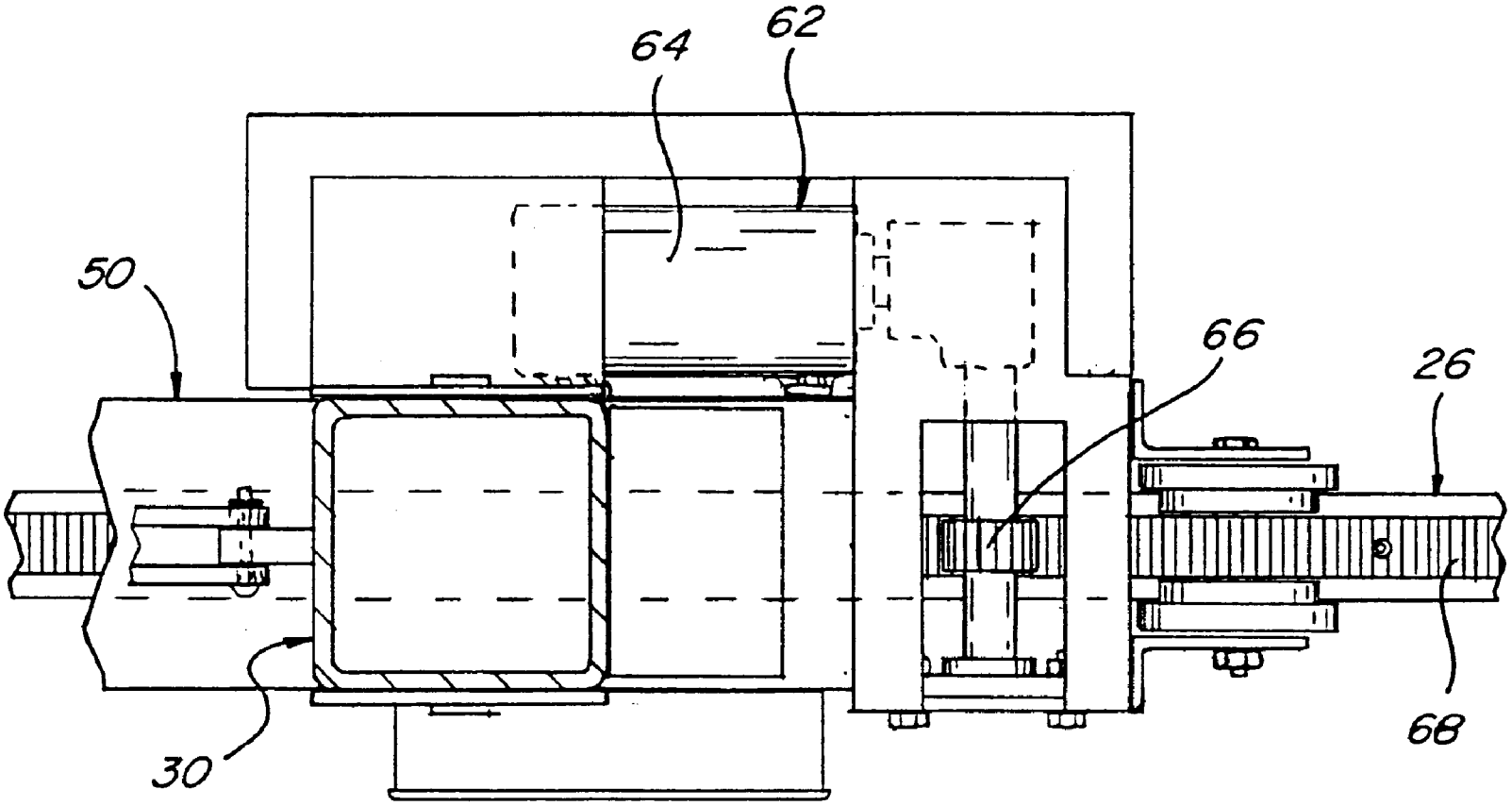
FIG. 5 is a bottom view of the apparatus of FIG. 1 showing a motor and drive assembly for moving the probe thereof longitudinally into and out of the concrete mixing drum.

Referring also to FIG. 5, a motor and drive assembly 62 operable for moving probe 26 axially is shown. Motor and drive assembly 62 includes an electric motor 64 mounted on guideway support 50 and connected in driving relation to a pinion 66 enmeshed with a rack 68 extending longitudinally along a substantial portion of probe 26. Rack 68 is preferably made from a polymeric material such as nylon due to its light weight, and its resistance to attack by alkali, non-reactivity electrically with magnesium, and low frictional properties. Referring in particular to FIG. 3, motor 64 is electrically connected by wires contained in a conduit 72 to a controller 70 mounted to column 48. Electrical power is provided to controller 70 from a power source (not shown) by power cord 74. Controller 70 further includes an operator controllable on/off switch 76 and a directional control switch 78 operator operable for moving probe 26 longitudinally into and out of a mixing drum. Stop switch 42 and proximity switch 46 are operable in conjunction with controller 70 to limit the extent of movement of probe 26 such that the probe and nozzles 38 will not be damaged by contact with the end of a drum, and such that the probe will not travel so far in either direction such that rack 68 and pinion 66 are disengaged.

Column 48 includes two sections, a lower section 80 and an upper section 82, lower section 80 preferably being constructed of 5"×5" square steel tubing, and upper section 82 being constructed of 6"×6" square steel tubing mounted in telescoping relation over lower section 80. Upper section 82 slides over lower section 80 on bearings of a polymeric material having self-lubricating properties such as Delrin brand thermoplastic available from DuPont, or other suitable lubricating material. A second motor and drive assembly 84 mounted on upper section 82 is drivingly connected to a threaded rod mounted inside column 48 and supporting upper section 82 via a conventional fixed nut and bearing to raise or lower the upper section 82 relative to lower section 80 as desired. Motor and drive assembly 84 is electrically connected to controller 70 by wires contained in conduit 72 and is controlled by a second on/off switch 86 and a second directional control switch 88. Motor and drive assembly 84 is operable using switches 86 and 88 to raise and lower upper section 82, guideway support 50 and probe 26, through a range of from about 3 to about 4 feet to enable adjusting the height of probe 26 for use with different trucks. A horizontal base plate 90 welded to lower section 80 is attachable to a concrete pad, foundation or other member with bolts 92 in the conventional manner.

The preferred pump 32 is a high pressure pump operable to pressurize fluid discharged through nozzles 38 at at least about 300 psi, and as high as about 8000 psi, and most preferably within a range of from about 1000 to about 4000 psi, at a flow rate of from about 4 to about 12 gallons per minute. Pump 32 may be powered by electricity, fossil fuel or any other means, a commercially available gasoline powered high pressure pump being shown. The preferred fluid used for cleaning is water, free of particulate matter, received through hose 94 from a water source, such as tank 96. Recycled water is usable, as long as the water is adequately treated to remove sand and cement particles. Flow of fluid under pressure from pump 32 to nozzles 38 is controlled by a solenoid valve 98 operable using a switch 100 on controller 70 connected to the solenoid valve via wires 102. Switch 100 is operable to open valve 98 to allow fluid flow to nozzles 38 when located in a drum such as the drum 12, and to close valve 98 to allow recirculation of the fluid through pump 32. Solenoid valve 98 is also preferably controllable by proximity switches 46 on guideway support 50 such that when a predetermined magnet 44 on probe 26 is sensed, valve 98 is opened to commence the cleaning operation. Then, as probe 26 is withdrawn from the drum such that a magnet 44 closer to forward end portion 34 is sensed by proximity switch 46, valve 98 is closed. Here, it should be recognized and understood that more than one magnet 44 and proximity switch 46 can be used at each opposite end of guideway 50, the magnets 44 being located at different locations corresponding to the lengths of different drums, and the proximity switches 46 for sensing the different magnets being selectively activated for selecting a drum length. Still further, solenoid valve 98 can optionally be controlled by directional control switch 78 to close when probe 26 is moved in one direction or the other.

Operation of apparatus 10 can be performed in various ways. One preferred method of operation is to position a ready-mix delivery truck such as truck 14 a suitable distance away from forward end portion 34 of probe 26, with drum axis 16 and axis 28 of the probe in the desired relation. Switches 86 and 88 can then be operated, as required, to position probe 26 at the proper height for the drum to be cleaned. If necessary, turnbuckle 54 can be adjusted to achieve the desired angular relationship between drum axis 16 and axis 28 of the probe. Motor 64 is then energized using switches 76 and 78 to drive probe 26 through open end 18 of the drum and into the interior thereof. Here, the travel of probe can be operator controlled using visual indicia such as marks 104 (FIG. 3) on the probe corresponding to different truck lengths, or the travel can be controlled by one or more of the proximity switches 46, or stop switch 42, to fully extend probe 26. With probe 26 fully extended in the drum, the drum is rotated in the direction for discharging the contents thereof. Solenoid valve 98 is then opened, either by moving switch 78 to the retract mode or using a separate switch, and probe 26 is moved slowly out of the drum while the fluid discharged from nozzles 38 impinges any residual concrete on the interior surfaces of the drum thereby loosening or dislodging the residual concrete. Here, it should be noted that it is important that at least one of nozzles 38 is pointed in a rearward direction preferably at an acute angle relative to axis 28 of probe 26 such that accumulated concrete on surfaces 25 of ribs 24 opposite open end 18 is reached by the fluid streams and dislodged. The horizontal orientation of the nozzle array, or a more upwardly directed discharge pattern has been found to facilitate cleaning such that the fluid does not impinge collected water in the bottom of the drum, and is safer because the high pressure streams are not pointed downwardly so as to possibly injure a person standing by the probe in the event of accidental operation with the nozzles located outside of a drum. When the drum is fully cleaned, fluid flow is then turned off either manually, or when one of the proximity switches 46 is activated, and probe 26 is moved until fully withdrawn from the drum. As an alternative method, the flow can be directed through nozzles 38 as probe 26 is moved into the drum, or both during insertion into and withdrawal from the drum.

Here, it should also be noted and understood that it is contemplated that alternative structures and drive mechanisms for apparatus 10 could be used. For instance, probe 26 could be a telescoping structure operably extended and retracted using a threaded rod and fixed nut or other suitable mechanism. Similarly, a rack and pinion or other mechanical drive can be utilized instead of the threaded rod and nut mechanism discussed above for raising and lowering probe 26. Also, a powered mechanism could be provided in cooperation with or in lieu of turnbuckle 54 for varying the angle of probe 26. Further, a constant discharge stream from nozzles 38 could be used, or a pulsating stream, as desired. Other support structures can likewise be used, such as a gantry wherein the probe is suspended.

Figure 6:
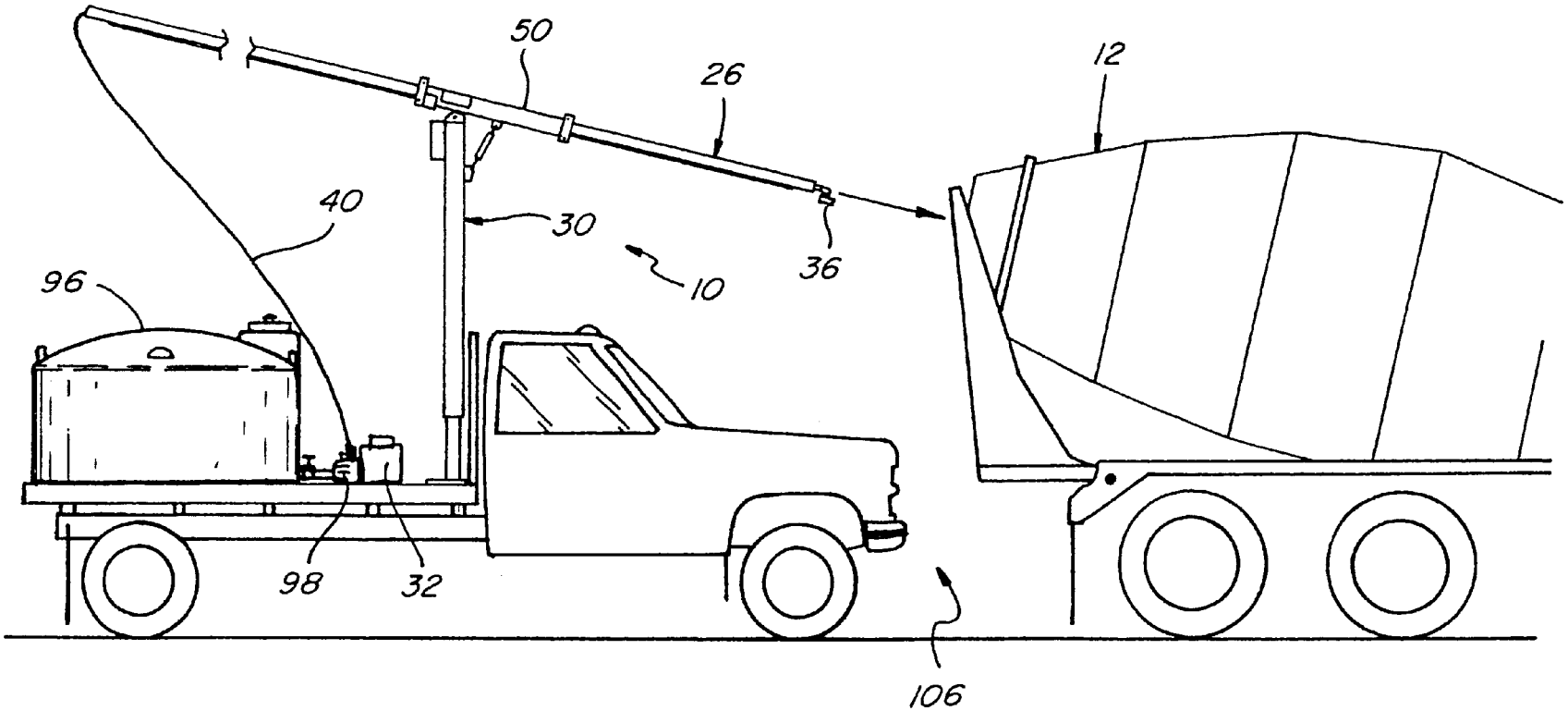
FIG. 6 is a side view of the apparatus of FIG. 1, shown mounted in the bed of a truck for mobile operation.

Referring to FIG. 6, apparatus 10 is shown mounted atop the bed of a truck 106 for mobile operation. Support structure 30 is shown mounted to the truck, with probe 26 movable into and out of a drum, such as the drum 12, using controls such as controller 70 located inside, or, outside of the operating cab of the truck. Pump 32 and tank 96 are also mounted on the truck, hose 40 connecting pump 32 with nozzle manifold 36 as explained above.

What is claimed is:

1. Method for removing concrete from interior surfaces of a concrete mixing drum, the drum including an open end communicating with the interior and at least one interior surface facing away from the open end, the method comprising the step of:

rotating the drum while moving at least one fluid discharge nozzle mounted adjacent to an end of an elongate probe longitudinally through the drum interior, the fluid nozzle being positioned and operated so as to discharge a stream of fluid against the at least one interior surface facing away from the open end under sufficient pressure to remove at least some of any concrete thereon that has not fully cured, the probe including a stop switch mounted adjacent the end thereof which is moved in the drum for contacting an end of the drum opposite the open end for initiating movement of the probe outwardly from the drum.

2. The method of claim 1, wherein the pressure is within a range from about 300 to about 8000 psi.

3. The method of claim 1, wherein the pressure is within a range from about 1000 to about 4000 psi.

4. The method of claim 1, wherein the elongate probe is oriented at between about an 11° and about a 13° angle to horizontal as it is moved in the drum.

5. A method for removing concrete from interior surfaces of a concrete mixing drum including an open end, the surfaces including at least one helical interior surface facing away from the open end, the method comprising the steps of:

providing an elongate probe having a longitudinal axis in an axially extending forward end portion adapted for insertion into the drum through the open end thereof;

providing adjustable support structure supporting the probe and positionable at an external location relative to the drum for positioning the drum at a variable elevation and a variable angular orientation relative to horizontal for insertion into the drum;

providing at least one fluid nozzle mounted on the probe in position for discharging a stream of fluid against the at least one helical interior surface facing away from the open end; and moving the forward end portion of the probe into the interior of the drum through the open end thereof and along the at least one helical interior surface while discharging a stream of fluid against the at least one helical interior surface through the at least one fluid nozzle for removing accumulated concrete from the surface.

6. The method of claim 5, wherein the drum is rotated as the probe is moved therethrough.

7. A method for removing concrete from interior surfaces of a rotatable concrete mixing drum, the drum having an open end communicating with an interior of the drum and at least one raised helical flight extending around the interior from a location spaced from the open end to a location adjacent to the open end for lifting concrete in the interior to the open end for discharge therethrough when the drum is rotated in a predetermined direction, the interior surfaces including at least one helical surface on the at least one raised interior helical flight along the extent thereof facing away from the open end, the method comprising the steps of:

providing an elongate probe having a longitudinal axis and an axially extending forward end portion for insertion into the drum through the open end thereof, and at least one fluid nozzle mounted to the forward end portion of the probe in a position such that when the forward end portion is located in the drum, a stream of fluid under pressure can be discharged through the nozzle against the at least one interior surface on the at least one helical flight facing away from the open end of the drum; and positioning the forward end portion of the probe for insertion into the drum through the open end thereof, and moving the forward end portion into and through the drum while discharging a stream of fluid under pressure from the at least one nozzle against the at least one interior surface on the at least one helical flight facing away from the open end of the drum for removing at least some of any accumulated concrete thereon.

* * * * *